United States Patent [19]

Fraioli

[11] Patent Number: 4,702,693

[45] Date of Patent: Oct. 27, 1987

[54] GAS-FIRED INFRARED HEATER

[76] Inventor: Joseph Fraioli, 8 Seymour Pl., White Plains, N.Y. 10605

[21] Appl. No.: 937,220

[22] Filed: Dec. 3, 1986

[51] Int. Cl.[4] ..... F23D 14/12

[52] U.S. Cl. ..... 431/348; 126/92 R

[58] Field of Search ..... 431/347, 348; 126/92 R, 126/92 AC

[56] References Cited

U.S. PATENT DOCUMENTS

| | | | |
|---|---|---|---|
| 3,366,156 | 1/1968 | Belknap | 431/348 |
| 3,881,858 | 5/1975 | Fitzgerald | 431/348 |
| 4,507,083 | 3/1985 | Fraioli | 432/222 |

*Primary Examiner*—Carroll B. Dority, Jr.
*Attorney, Agent, or Firm*—Michael Ebert

[57] ABSTRACT

A gas-fired infrared heater for projecting an infrared beam in a directional radiation pattern. The heater is constituted by a ribbon-type burner and a refractory body of a material radiating infrared energy when heated to an elevated temperature by the burner. The burner is formed by a metal pipe having a longitudinally-extending outlet defined by a pair of parallel plates projecting laterally from the pipe and having a set of corrugated ribbons therein, a pad of thermal insulation being secured to the outer surface of each plate, whereby when a mixture of air and gas is fed into the pipe and ignited, a sheet of flame emerges from the outlet. The burner is received within a longitudinally-extending internal channel in the refractory body, the outlet being then aligned with an internal cavity so that the flame emerging from the outlet impinges on a surface of the cavity to heat this surface to an elevated temperature causing it to emit infrared radiation. The cavity communicates with an array of openings in the body which form radiation horns to produce the desired directional infrared radiation pattern. Because the burner is thermally shielded in the channel, metal fatigue and deleterious distortion of the ribbons is avoided even at very high operating temperatures.

9 Claims, 7 Drawing Figures

GAS-FIRED INFRARED HEATER

BACKGROUND OF INVENTION

1. Field of Invention

This invention relates generally to infrared burners constituted by a ribbon type gas fired burner and a refractory body which when heated by the burner projects an infrared beam in a directional radiation pattern, and more particularly to a heater of this type in which the burner which is of metallic construction is accommodated within the refractory body and is so shielded from heat as to avoid metal fatigue.

2. Status of Prior Art:

The transfer of heat takes place by three processes: conduction, convection and radiation. In conduction, heat is transferred through a body by the short range interaction of molecules and/or electrons. Convection involves the transfer of heat by the combined mechanisms of fluid mixing and conduction. In radiation, electromagnetic energy is emitted toward a body and the energy incident thereto is absorbed by the body to raise its temperature. Radiant heating, therefore, differs from both convection and conduction heating, for the presence of matter is not required for the transmission of radiant energy.

According to the Stefan-Boltzmann law, the rate of heat transfer between a source of radiated heat whose temperature is $T_s$ and an absorbing body whose temperature is $T_b$ is equal to $T_s^4 - T_b^4$; that is, to the difference between the fourth powers of these temperature values. In convection heating, the rate of heat transfer is proportional only to the temperature difference between the body being heated and the surrounding atmosphere. Hence convection heating is inherently very slow, as compared to the nearly instantaneous effects of radiant heating.

Though an IR heater in accordance with the invention may be used throughout the full range of heating applications, including industrial processes such as industrial finishing and textile treatment, as well as in annealing, curing and drying operations which require heating, it will mainly be described herein in connection with the heating of food products; for the invention has particular advantages in that context.

While a food product typically undergoes cooking or baking at a temperature in the range of about 140° to 200° F. whose upper value is below the boiling point of water (212° F.), it is nevertheless necessary in a conventional convection oven to establish a much higher oven temperature—usually well over 400° F. The reason for this requirement is that the transfer of heat between the hot atmosphere of the convection oven and the body of food takes place at a fairly rapid rate only when the temperature differential therebetween is great.

If, therefore, the food placed in an oven is initially at room temperature and the oven temperature is held at about 200° F., then as the body of the food becomes warmer and its surface temperature rises to, say, 150° F., the rate of heat transfer as the temperature differential narrows thereafter becomes increasingly slow, and the cooking or baking process is protracted. On the other hand, if the oven temperature is raised to 400° F. or 500° F. to speed up baking, this means that the entire volume of air in the oven must be at this elevated temperature, and this entails a relatively large energy expenditure. With rising energy costs, this factor adds substantially to the cost of baking and is reflected in the cost of the product to the consumer. Also, with convection ovens, the flow of hot air over the surface of the food product tends to deprive it of moisture and volatile constituents and therefore degrades the quality of the product.

Radiation heaters in present commercial use are of the infrared type, the infrared band of thermal radiation lying within the electromagnetic wave spectrum. The quality and intensity of radiation in the infrared band of 0.7 microns to 400 microns depends on the temperature of the radiating body. If, therefore, the radiating body is a refractory ceramic heated by a gas-fired jet burner, one can only accurately adjust the quality and intensity of the IR radiation if it is possible to carefully control the operation of the gas-fired burner.

Despite the fact that IR heaters are much more economical to operate and act with extreme rapidity, and IR heaters are therefore far superior in this regard to convection ovens for cooking or baking food, they have enjoyed limited success in the baking industry. The reason for this is that commercially available gas-fired IR heaters are relatively difficult to control and also give rise to an uneven baking action.

Effective infrared heating depends not only on the radiant source temperature but also on what is referred to as the "geometric view factor." This factor determines the relationship between the pattern of IR radiation and the surface of the product being heated. With the typical IR heating arrangement, portions of the product to be heated are more completely exposed to IR rays and will be heated more rapidly to a high temperature than those portions that are not as fully exposed. As a consequence, the product may not be properly baked and may not be commercially saleable.

The drawback of IR heating with existing equipment is recognized in the article "Radiant Convection Heating—A Marriage of Two Systems" by H.J. Bennett, which appeared in the journal Industrial Gas for February 1976. In order to overcome the uneven heating experienced with IR heating, the author proposes combining an IR heater with a convection heater so as to provide a heating technique somewhat faster than convection heating, yet with the uniformity and controlled temperature characteristics of convection heating.

The fact is, however, that the synthesis of IR and convection heating represents a compromise that is not entirely satisfactory, for it requires much more energy than IR heating and also a confined oven as well as separate controls for the heater and the oven.

Ideally, with a food product, such as dough to be baked, having an exposed surface of given dimensions, the geometry of the IR beam impinging on this surface should be such as to impinge on all points thereon IR rays of equal intensity so that the baking is uniform throughout the body of the food. But existing IR heaters are incapable of producing an IR radiation pattern of uniform flux density which is so shaped as to uniformly irradiate and heat a given food product.

It is known to provide infrared heaters in which a refractory body is heated by means of a ribbon-type burner to an elevated temperature causing it to emit infrared radiation.

The ribbon-type burner is of the type disclosed, for example, in the Flynn U.S. Pat. No. 3,437,322, the gas-air fuel mixture is fed into a cylinder having a longitudinal slot therein occupied by a stack of corrugated ribbon to create an array of minute jet openings through which the gas-air mixture is expelled. Because of the myriad of jet openings, the projected flame is not composed of discrete jets but assumes a sheet-like form.

However, the intensity of the flame is not uniform throughout the length of the ribbon, for the pressure of the gas-air mixture in the cylinder is not equalized throughout its length. Hence, the resultant infrared radiation pattern is not of uniform intensity; and when food is subjected to this pattern, the heating thereof may be uneven.

In order to overcome this problem, my prior U.S. Pat. No. 4,507,083 (1985) discloses a gas-fired infrared heater for projecting an infrared beam in a radiation pattern having a predetermined geometry for irradiating the surface of a food product or other body to effect uniform heating thereof at a rapid rate. The heater includes a ribbon-type burner having an elongated premix casing into which is fed air and gas, and an outlet extending along a slot in the casing and projecting therefrom. The outlet is provided with two sets of corrugated ribbons separated by a gas pressure chamber, whereby the air-gas mixture from the casing passes through one set into the chamber where the pressure thereof is equalized before the mixture passes through the other set from which it emerges as a sheet of flame of uniform intensity. The outlet is inserted in the longitudinal socket of a refractory body to impinge on a surface thereof whereby the surface is heated to a temperature level causing the surface to emit infrared energy which is projected by an array of radiation horns formed in the assembly.

As pointed out in my above-identified patent, in an infrared heater which makes use of a gas-fired burner to heat a refractory body to produce infrared radiation, some of the infrared energy from the refractory body is directed back toward the ribbon type burner. With prolonged operation, this infrared energy which is absorbed by the metal of the heater results in metal fatigue and may render the burner inoperative.

In order to overcome this problem, my prior patent shapes the cavity in the refractory body so that the surface thereof onto which the flame impinges is inclined relative to the outlet of the ribbon burner at an angle at which no infrared energy from this surface is directed toward said outlet.

However, while this is an adequate solution to this problem for operating temperatures running as high as 800° F., when the operating temperatures are very high—that is, above 1200° F.—then with prolonged operation, the ribbon burner is subjected to temperatures which not only result in metal fatigue but also in the deformation of the stainless steel ribbons which define the array of minute jet openings through which the gas-air mixture is expelled. These myriad openings normally have a substantially uniform diameter and result in a projected flame whose intensity is uniform throughout the length of the ribbon, assuming that the pressure of the gas-air mixture is equalized throughout this length.

But if the metal ribbons become distorted because of heat fed back to the burner outlet by the refractory body, then the jet openings will no longer be of uniform diameter, and the resultant flame will be of uneven density. Hence the burner will not operate properly.

Of background interest in regard to infrared burners are the following patents:

| | | |
|---|---|---|
| 1,486,036 | 3/1924 | Rinsinger |
| 1,529,871 | 3/1925 | Conroy et al. |
| 2,200,169 | 5/1940 | Hammick |
| 2,731,010 | 1/1956 | Moore et al. |
| 3,326,263 | 6/1967 | Milligan |
| 3,437,322 | 4/1969 | Hynn |
| 3,954,388 | 5/1976 | Hildebrand |
| 4,432,727 | 2/1984 | Fraioli |

SUMMARY OF INVENTION

In view of the foregoing, the main object of this invention is to provide an infrared heater for projecting an infrared beam in a directional radiation pattern which makes use of a ribbon-type burner producing a sheet of flame, the burner being received in a refractory body and being so shielded from heat emitted by the body as to avoid metal fatigue and distortion of the ribbons.

Also an object of the invention is to provide an infrared heater of the above type which is of the single burner or double-burner type to create a simplex or duplex unit.

Yet another object of the invention is to provide infrared heaters whose refractory body is constituted by replaceable modular blocks whereby the heater may be readily assembled and repaired.

Briefly stated, these objects are attained in a gas-fired infrared heater for projecting an infrared beam in a directional radiation pattern. The heater is constituted by a ribbon-type burner and a refractory body of a material radiating infrared energy when heated to an elevated temperature by the burner. The burner is formed by a metal pipe having a longitudinally-extending outlet defined by a pair of parallel plates projecting laterally from the pipe and having a set of corrugated ribbons therein, a pad of thermal insulation being secured to the outer surface of each plate, whereby when a mixture of air and gas is fed into the pipe and ignited, a sheet of flame emerges from the outlet. The burner is received within a longitudinally-extending internal channel in the refractory body, the outlet being then aligned with an internal cavity so that the flame emerging from the outlet impinges on a surface of the cavity to heat this surface to an elevated temperature causing it to emit infrared radiation. The cavity communicates with an array of openings in the body which form radiation horns to produce the desired directional infrared radiation pattern. Because the burner is thermally shielded in the channel, metal fatigue and deleterious distortion of the ribbons is avoided even at very high operating temperatures.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
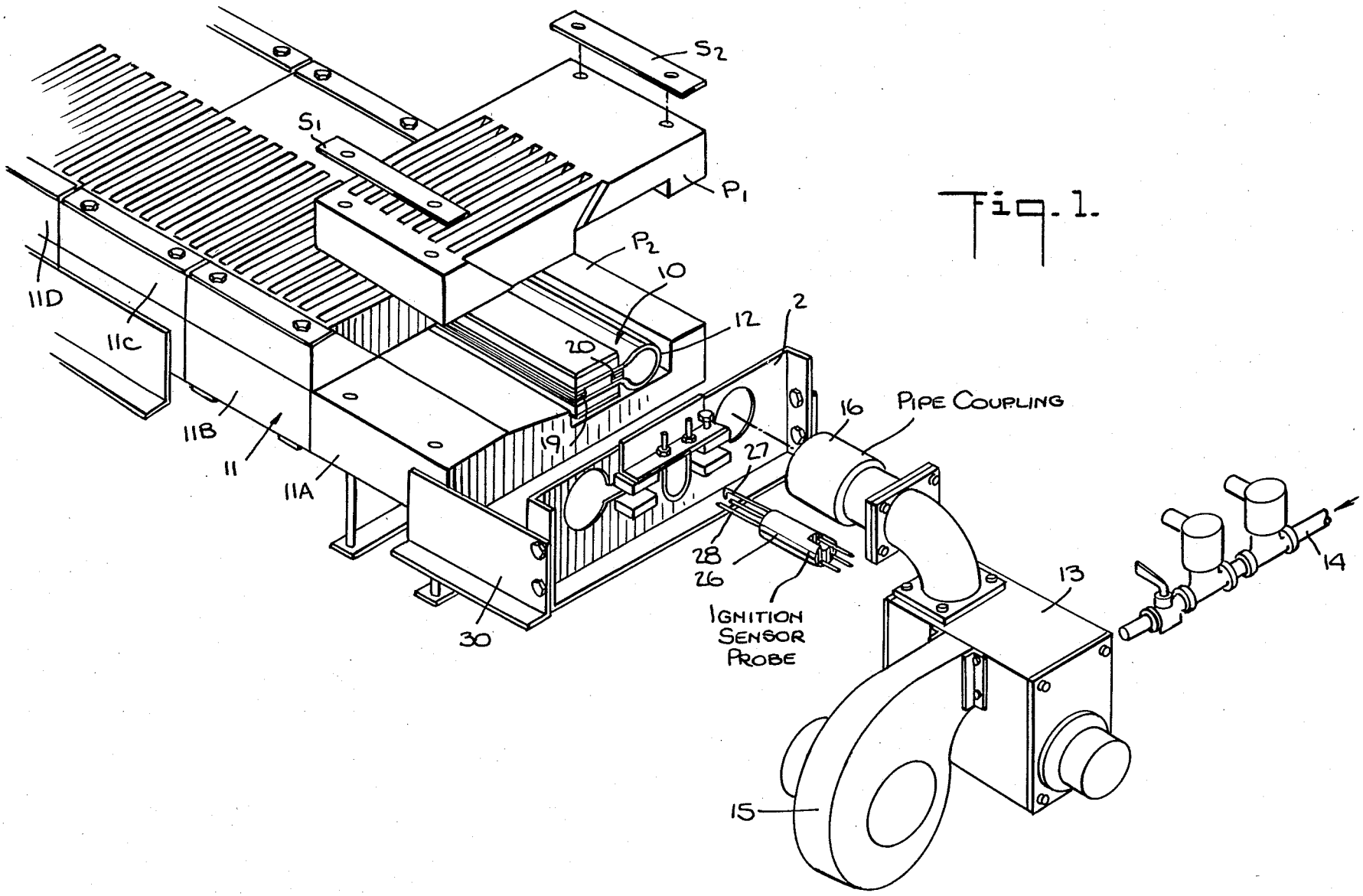
FIG. 1 is a perspective view of a simplex infrared heater in accordance with the invention, one of the modular block pieces of the refractory body being raised to expose the ribbon-type burner.

The Simplex Unit:

Referring now to FIG. 1, there is shown a simplex infrared heater according to the invention constituted by a ribbon-type gas-air burner, generally designated by numeral 10, which cooperates with a refractory body, generally designated by numeral 11.

The burner includes a pre-mix pipe 12 of a suitable metal such as cast iron or stainless steel. Pipe 12 is supplied with a mixture of air and gas through a dual valve air-gas controller 13, preferably of the type disclosed in my copending application Ser. No. 780,666, filed Sept. 26, 1985 and now U.S. Pat. No. 4,640,678. This controller is supplied with pressurized gas through an inlet line 14 and pressurized air through an air blower 15.

Controller 13 is adapted to mix the incoming air and gas to produce a combustible output mixture and to adjust the flow rate thereof without, however, altering the air/gas ratio. The output of controller 13 is supplied by a coupler 16 to the inlet of burner pipe 12 whose other end is closed. The preferred air/gas ratio is the stoichiometric ratio that results in complete combustion in the burner. Thus, in the case of methane gas, this ratio is 64 grams of oxygen to 16 grams of methane. However, every chemical reaction has its characteristic proportions; hence the ratio for optimum efficiency will depend on the gaseous fuel being used.

Since the optimum ratio, once it is set, is never varied by controller 13, this ratio is maintained as the flow rate is adjusted. Hence one may accurately vary the intensity of heat produced by the burner and the resultant temperature of the refractory body.

Figure 5:
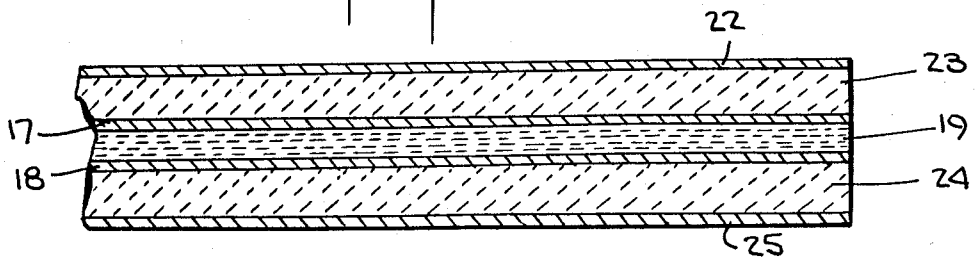
FIG. 5 is a side view of the burner.
Figure 4:
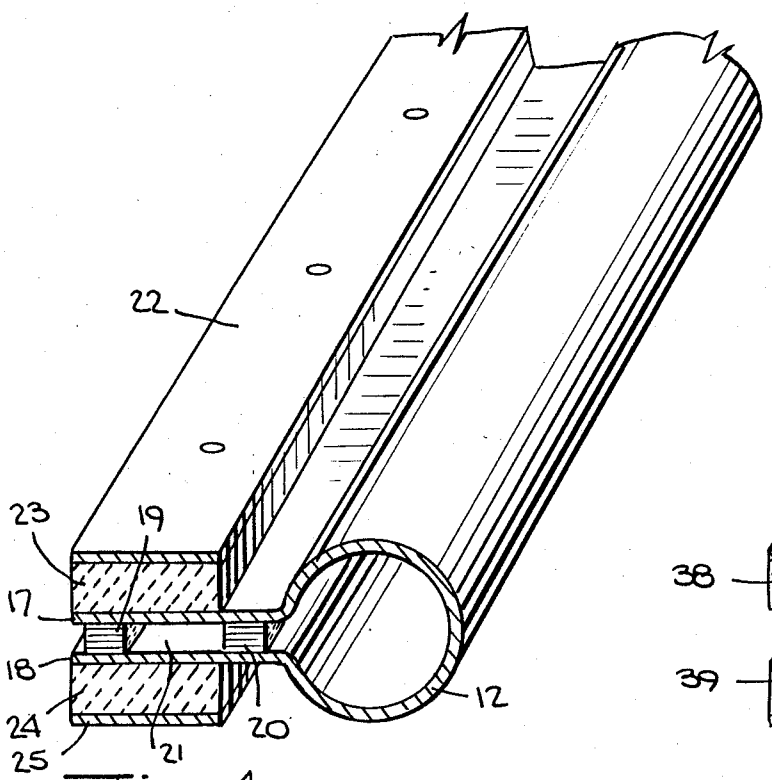
FIG. 4 is a perspective view of the ribbon-type burner included in the simplex heater.

As best seen in FIGS. 4 and 5, the pre-mix pipe 12 of the burner is provided with a longitudinally-extending slot which is defined by a pair of parallel metal plates 17 and 18 integral with pipe 12 and extending laterally therefrom to form the outlet of the burner. The front end of the outlet is occupied by a stack of corrugated ribbons forming a first set 19. The corrugated ribbon stack creates an array of minute jet openings through which the gas-air mixture is forced. The configuration of the ribbons is such as to provide two distinct type of jet ports, one being a main flame jet port which is of the high velocity type causing the gas-air mixture to project with sufficient energy to form a long flame, the others on either side of the main flame jet port being pilot jet ports of the low velocity type to produce relatively short flames for sustaining the long main flame. Because of the longitudinally-extending outlet arrangement and the myriad jet openings created by the ribbons, the projected main flame is not composed of discrete jets, but assumes a sheet-like form.

At the inner end of the burner outlet is a parallel set 20 of corrugated ribbons. These are separated from the first set by an air-gas pressure chamber 21. In operation, the air and gas fed into pipe 12 are pre-mixed therein, the mixture being forced through the second set of ribbons 20 to pass into the pressure chamber for more thorough secondary mixing therein.

Because the flow of the mixture through the outlet is retarded between the two sets of ribbons, both of which offer fluidic impedance, this retarding action serves to equalize the pressure in chamber 21. Thus, while the pressure throughout the pre-mix chamber tends to vary at various regions therein, the pressure of the mixture when it is ejected into the atmosphere from the first set of ribbons is equalized, and the resultant sheet of flame has an equalized intensity giving rise to an infrared beam of uniform intensity.

In order to prevent distortion of the ribbons in the two sets thereof in the outlet as a result of excessive heat, clamped onto the upper plate 17 of the outlet by a clamping strip 22 is a pad 23 of thermal insulation material. In practice, pad 23 may be of the same material as that of the refractory body. The lower plate 18 of the outlet has a like thermal insulation pad 24 clamped thereto by a strip 25.

As shown in FIG. 1, ignition of the air-gas mixture in the outlet of the burner is effected by a probe 26 provided with an ignition spark gap 27 and a heat sensor element 28. This sensor makes it possible to effect automatic control of the burner in the manner disclosed in the above-identified copending application, whose entire disclosure is incorporated herein by reference.

The refractory body 11 is composed of a bank of four identical modular blocks 11A, 111B, 11C and 11D. Each block is formed by complementary upper and lower pieces $P_1$ and $P_2$ which are clamped together by clamping strips $S_1$ and $S_2$ and bolts. The four blocks are supported in side-by-side relation within a frame constituted by front and rear end plates 29 and side plates 30 which are bolted together. In practice, a greater or less number of blocks may be used to form a refractory body, depending on the length of the burner pipe.

Each block is composed of refractory material, a preferred material for this purpose being "Cera Form," a refractory produced by Johns-Manville of Denver, Colo., made from a wet slurry formulation that includes refractory fibers and multi-component binder systems. Thus "Cera Form" type 103 includes Alumina (39.6%) and Silica (50.7%). Because the material can be molded, it can be made into the special shapes called for in the present application. In practice, however, the refractory body may be molded in integral form rather than being made up of individual blocks or modules. While a fibrous refractory body has been disclosed, the infrared emitting material may be of ceramic or any other suitable composition.

Figure 2:
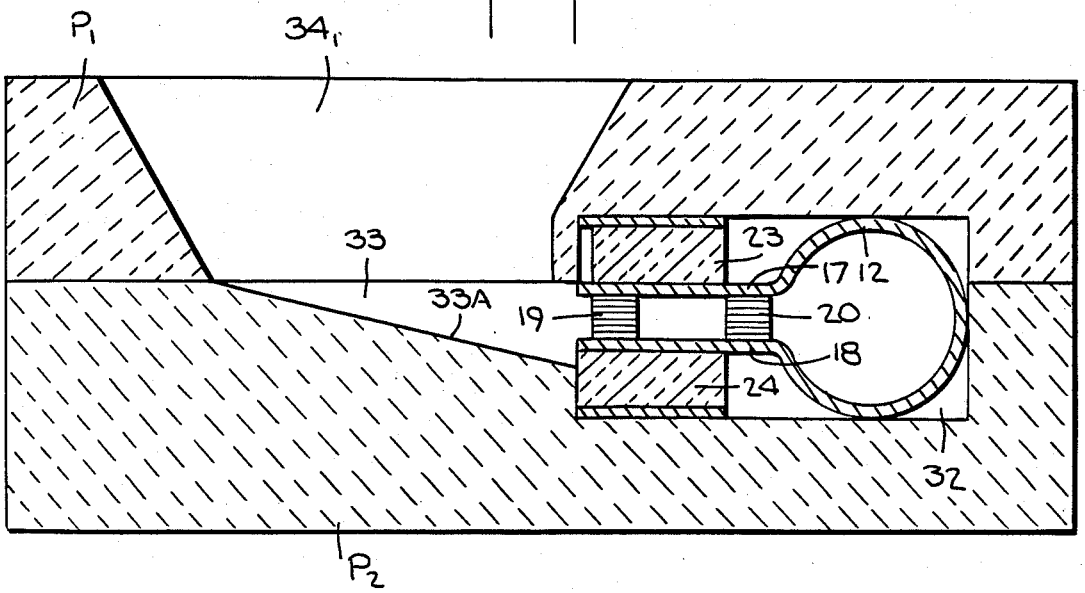
FIG. 2 is an end view of a simplex modular block included in the simplex heater.
Figure 3:
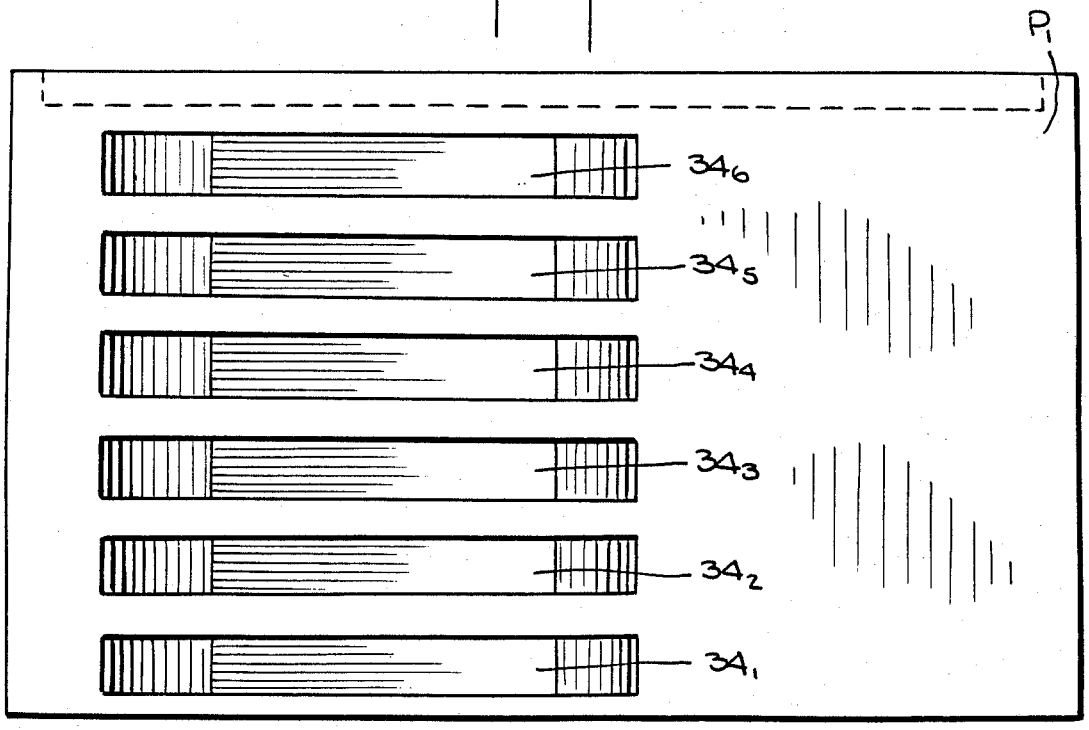
FIG. 3 is a top view of the modular block.

The pieces $P_1$ and $P_2$ of each block, as shown in FIGS. 2 and 3, are molded or otherwise formed so as to create, when the pieces are joined together, an internal channel 32 therein having a rectangular cross section whose dimensions are such as to snugly accommodate the ribbon burner 10. Channel 32 which receives the burner communicates with an interior cavity 33 formed in lower piece $P_2$.

Burner 10 is so placed in the channel as to align its outlet with cavity 33 in the refractory body so that the flame emitted therefrom impinges the wall surface 33A to produce a high density flux of maximum radiance. The flame is not the source of infrared radiation, for its function is to heat the surface of the refractory to a temperature level (i.e., 1800° to 2200° F.) at which the refractory then emits infrared energy in the micron range to effect the desired heating of the product subjected to the IR radiation pattern.

As the temperature of the refractory surface is increased, the maximum IR radiation occurs at shorter wavelengths and has a much higher intensity, with an increasingly greater portion of the radiation occurring nearer the visible range in the electromagnetic spectrum. Infrared rays travel in a straight line until they strike an absorbing surface; hence radiant heat follows the same physical laws as light waves and travel at the same speed.

Formed in upper piece $P_1$ is a parallel array of six rectangular radiation horns $34_1$ to $34_6$ having side walls which converge toward cavity 33. Hence the infrared radiation emitted from surface 33A of the cavity is projected through the horns to provide a radiation pattern which depends on the geometry of the horns.

In operation, infrared radiation emitted by inclined surface 33A of the refractory body is directed toward the radiating horns for projection toward the surface of an object to be heated. However, the angle of inclination of surface 33A is such that no radiant energy is directed toward the outlet of the ribbon burner; hence the burner is protected from the consequences of radiant heat.

As pointed out previously, when the infrared heater is operating in a very high temperature range, the burner may then be subjected to back heat sufficiently high to cause deformation of the ribbons thereon and metal fatique of the burner structure with deleterious results. But because burner 10 is housed within internal cavity 32 in the refractory body it is thermally shielded from the infrared energy emitted in internal cavity 33 and projected through the radiation horns. Because of the sensitivity of the ribbons in the outlet to excessive heat, additional thermal shielding is provided by the thermal insulation pads which protect the outlet plates and isolate the ribbons from deleterious back heat that would otherwise distort the jet openings defined by the ribbons.

Because of the modular arrangement, assembly of the unit can be carried out without difficulty; for it is a simple matter to first place the lower pieces $P_1$ of the blocks forming the refractory body in the frame, then place the ribbon burner 10 in the lower half of channel 32, after which the upper pieces $P_2$ of the blocks are placed over the ribbon burner and clamped to the lower blocks to complete the unit. The unit may be readily disassembled, when necessary, to replace any component thereof.

Figure 7:
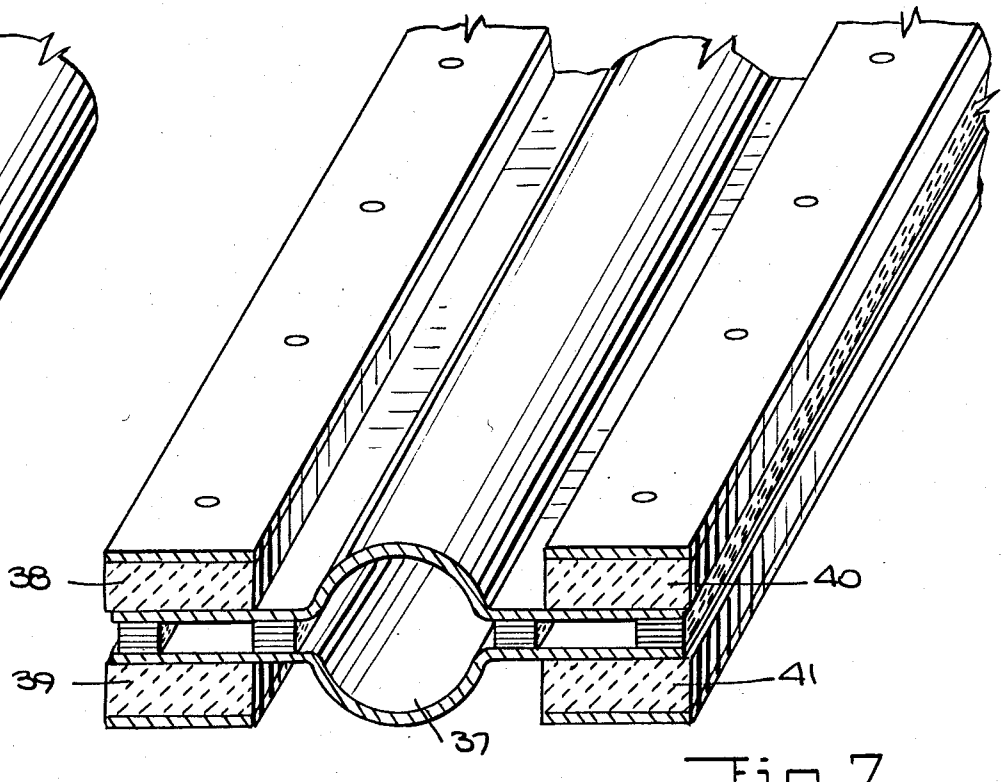
FIG. 7 is a perspective view of the ribbon type burner included in the duplex heater.
Figure 6:
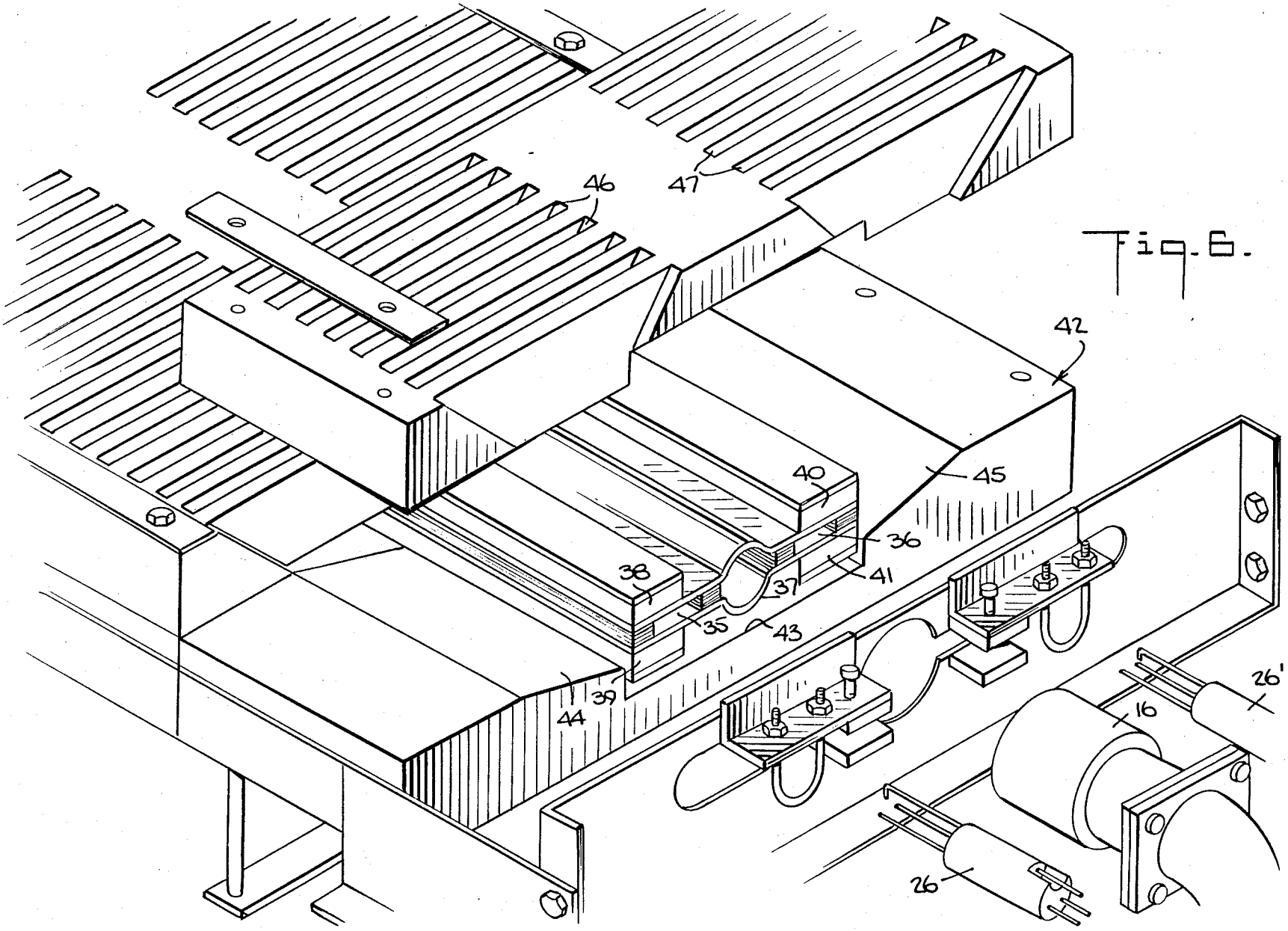
FIG. 6 is a perspective view of a duplex infrared heater in accordance with the invention.

Duplex Unit:

Referring now to FIGS. 6 and 7 showing a duplex infrared heating unit, it will be seen that this unit is a double-sided version of the single-sided simplex unit. Thus, in the duplex unit, the air-gas ribbon burner is provided with outlets 35 and 36 on diametrically-opposed sides of a central pre-mix pipe 37 which is supplied with an air-gas mixture by a coupler 16 as in the simplex unit. And instead of a single ignition and sensor probe 26, there is a like second probe 26', the probes cooperating with outlets 35 and 36, respectively. Each outlet has two sets of ribbons and the outlet plates thereof are thermally shielded by thermal insulation pads 38 to 41.

In this embodiment of the invention, the refractory body is composed of modular twin blocks 42, each block having complementary upper and lower pieces which when clamped together define an internal channel 43 for snugly accommodating the double-sided burner so that their twin outlets 35 and 36 are in alignment with opposing internal cavities in the refractory body having inclined surfaces 44 and 45. These cavities communicate with respective twin arrays of radiation horns 46 and 47. Thus, the operation of this duplex unit is identical to that of a simplex or single burner unit except for the doubling thereof so that radiation beams are projected from opposing sides of the unit, rather than from one side only.

Though the burners have been shown as having a cylindrical pre-mix pipe, in practice this pipe may have other cross-sectional forms such as square or rectangular.

While there has been shown and described a preferred embodiment of a gas-fired infrared heater in accordance with the invention, it will be appreciated that many changes and modifications may be made therein without, however, departing from the essential spirit thereof.

I claim:

1. A gas-fired infrared heater comprising:

A. a ribbon-type burner constituted by a metal pipe supplied with an air-gas mixture, a pair of parallel metal plates projecting laterally from a longitudinal slot on the pipe to define an outlet, a set of ribbons sandwiched between the plates at the front end of the outlet to form myriad jet openings whereby a sheet of flame emerges from the outlet when the mixture is ignited, and a pad of thermal insulation secured to the outer surface of each plate to protect said set of ribbons from excessive heating that would result in a distortion of the ribbons;

B. a refractory body of a material which when heated to an elevated temperature level emits infrared radiation, said body having an internal channel therein which accommodates and thermally shields the burner, an internal cavity formed in the body in alignment with the outlet of the burner and having a surface on which the flame impinges to cause this surface to emit infrared radiation, and at least one opening in the body communicating with the cavity to define a horn from which said infrared radiation is projected toward an object to be heated by infrared energy.

2. A heater as set forth in claim 1, wherein said outlet includes a second set of ribbons adjacent the rear end of the outlet to define between the two sets of ribbons a pressure chamber to equalize the pressure of the air gas mixture.

3. A heater as set forth in claim 1, wherein said body is formed by a bank of modular blocks in side-by-side relation, each block being composed of complementary upper and lower pieces which are shaped to define said channel, said cavity and said radiation horn.

4. A heater as set forth in claim 3, further including means to clamp together said pieces.

5. A heater as set forth in claim 4, further including a frame to accommodate said blocks.

6. A heater as set forth in claim 1, wherein said surface is inclined relative to the burner outlet at an angle at which no infrared energy from this surface is directed toward the outlet.

7. A heater as set forth in claim 1, wherein said pads are clamped to said plates.

8. A heater as set forth in claim 1, wherein said plates are integral with said pipe and are made of stainless steel.

9. A heater as set forth in claim 1, wherein said burner is provided with twin outlets at diametrically-opposed sides of the pipe, and said refractory body is provided with twin cavities which are associated with the twin outlets.

* * * * *